US011380259B2

(12) United States Patent
Gai et al.

(10) Patent No.: US 11,380,259 B2
(45) Date of Patent: Jul. 5, 2022

(54) PIXEL DRIVING CIRCUIT, PIXEL DRIVING METHOD, ARRAY SUBSTRATE, AND DISPLAY DEVICE

(71) Applicant: BOE TECHNOLOGY GROUP CO., LTD., Beijing (CN)

(72) Inventors: Cuili Gai, Beijing (CN); Yicheng Lin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 625 days.

(21) Appl. No.: 16/342,725

(22) PCT Filed: Nov. 13, 2018

(86) PCT No.: PCT/CN2018/115178
§ 371 (c)(1),
(2) Date: Apr. 17, 2019

(87) PCT Pub. No.: WO2019/196405
PCT Pub. Date: Oct. 17, 2019

(65) Prior Publication Data

US 2021/0366394 A1 Nov. 25, 2021

(30) Foreign Application Priority Data

Apr. 11, 2018 (CN) ..... CN201810320203.7

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01);
(Continued)

(58) Field of Classification Search
CPC ..... G09G 3/3233; G09G 2300/0819; G09G 2320/045; G09G 2360/148;
(Continued)

(56) References Cited

U.S. PATENT DOCUMENTS

2003/0142047 A1 7/2003 Inoue et al.
2005/0099372 A1* 5/2005 Nakamura ..... G06F 3/042 345/79

(Continued)

FOREIGN PATENT DOCUMENTS

CN 1353410 A 6/2002
CN 1459088 A 11/2003

(Continued)

OTHER PUBLICATIONS

Second Office Action for Chinese Application No. 201810320203.7, dated Apr. 29, 2020, 16 Pages.

(Continued)

*Primary Examiner* — Michael J Eurice
(74) *Attorney, Agent, or Firm* — Brooks Kushman P.C.

(57) ABSTRACT

The preset disclosure relates to a pixel driving circuit, a pixel driving method, an array substrate and a display device. The pixel driving circuit includes a pixel driving unit and an optical detection unit. The pixel driving unit is configured to drive a light-emitting element included in a pixel unit to emit light. The optical detection unit includes a photoelectric conversion sub-circuit and a switch control sub-circuit. The photoelectric conversion sub-circuit is configured to receive light emitted from the light-emitting element, and convert the light into an electrical signal. The switch control sub-circuit is configured to output the electrical signal under control of a first scanning signal. The pixel driving unit is configured to adjust brightness of the light emitted from the light-emitting element according to the electrical signal.

14 Claims, 4 Drawing Sheets

(52) U.S. Cl.
CPC ..... *G09G 2300/0842* (2013.01); *G09G 2320/0233* (2013.01); *G09G 2360/148* (2013.01)

(58) Field of Classification Search
CPC ... G09G 2300/0842; G09G 2320/0233; G09G 3/3258; G09G 3/3291; G09G 2320/0295; G09G 3/3283; G09G 3/3208; G09G 2300/0426; G09G 2310/0251; G09G 3/3225; G09G 2310/061; H01L 27/32
See application file for complete search history.

(56) References Cited

U.S. PATENT DOCUMENTS

| | | | | |
|---|---|---|---|---|
| 2006/0038751 | A1 | 2/2006 | Johnson et al. | |
| 2006/0256048 | A1 | 11/2006 | Fish et al. | |
| 2007/0024547 | A1 | 2/2007 | Jang et al. | |
| 2009/0141004 | A1* | 6/2009 | Yamazaki | H01L 33/005 345/204 |
| 2009/0243498 | A1 | 10/2009 | Childs et al. | |
| 2012/0068054 | A1 | 3/2012 | Sugita | |
| 2015/0002502 | A1 | 1/2015 | Kim | |
| 2015/0084946 | A1 | 3/2015 | Shim et al. | |
| 2017/0069263 | A1 | 3/2017 | Hu | |
| 2018/0005571 | A1 | 1/2018 | Song | |
| 2018/0151121 | A1* | 5/2018 | Lim | G09G 3/3233 |
| 2018/0336822 | A1 | 11/2018 | Yan et al. | |
| 2019/0005883 | A1* | 1/2019 | Kim | G09G 3/3233 |
| 2019/0206315 | A1* | 7/2019 | Park | G09G 3/3225 |
| 2021/0201772 | A1* | 7/2021 | Lin | G09G 3/3233 |

FOREIGN PATENT DOCUMENTS

| | | | |
|---|---|---|---|
| CN | 1685390 | A | 10/2005 |
| CN | 1826627 | A | 8/2006 |
| CN | 1833268 | A | 9/2006 |
| CN | 1846243 | A | 10/2006 |
| CN | 103680409 | A | 3/2014 |
| CN | 104252837 | A | 12/2014 |
| CN | 104409047 | A | 3/2015 |
| CN | 104464615 | A | 3/2015 |
| CN | 104900186 | A | 9/2015 |
| CN | 105023539 | A | 11/2015 |
| CN | 105718118 | A | 6/2016 |
| CN | 106531081 | A | 3/2017 |
| CN | 106875892 | A | 6/2017 |
| CN | 106920515 | A | 7/2017 |
| CN | 106981268 | A | 7/2017 |
| CN | 107204172 | A | 9/2017 |
| CN | 107464529 | A | 12/2017 |
| CN | 107564469 | A | 1/2018 |
| CN | 107863065 | A | 3/2018 |
| CN | 108538255 | A | 9/2018 |
| WO | 2010140466 | A1 | 12/2010 |

OTHER PUBLICATIONS

First Office Action for Chinese Application No. 201810320203.7, dated Sep. 27, 2019, 17 Pages.
International Search Report and Written Opinion for Application No. PCT/CN2018/115178, dated Feb. 1, 2019, 12 Pages.
2nd Chinese Office Action, English Translation.
CN104409047A, English Abstract and U.S. Equivalent U.S. Pub. No. 2017/0069263.
Non-English Language Reference, Corresponding English Language Information.
International Search Report and Written Opinion, English Translation.
1st Chinese Office Action, English Translation.
CN1353410A, English Abstract and Machine Translation.
CN1459088A, English Abstract and U.S. Equivalent U.S. Pub. No. 2003/0142047.
CN1685390A, English Abstract and U.S. Equivalent U.S. Pub. No. 2006/0038751.
CN1826627A, English Abstract and Machine Translation.
CN1833268A, English Abstract and U.S. Equivalent U.S. Pub. No. 2009/0243498.
CN1846243A, English Abstract and U.S. Equivalent U.S. Pub. No. 2006/0256048.
CN103680409A, English Abstract and Machine Translation.
CN104252837A, English Abstract and U.S. Equivalent U.S. Pub. No. 2015/0002502.
CN104464615A, English Abstract and U.S. Equivalent U.S. Pub. No. 2015/0084946.
CN104900186A, English Abstract and U.S. Equivalent U.S. Pub. No. 2018/0005571.
CN105023539A, English Abstract and Machine Translation.
CN105718118A, English Abstract and Machine Translation.
CN106531081A, English Abstract and U.S. Equivalent U.S. Pub. No. 2018/0336822.
CN106875892A, English Abstract and Machine Translation.
CN106920515A, English Abstract and Machine Translation.
CN106981268A, English Abstract and Machine Translation.
CN107204172A, English Abstract and Machine Translation.
CN107464529A, English Abstract and Machine Translation.
CN107564469A, English Abstract and Machine Translation.
CN107863065A, English Abstract and Machine Translation.
CN108538255A, English Abstract and Machine Translation.
WO2010140466A1, English Abstract and U.S. Equivalent U.S. Pub. No. 2012/0068054.

* cited by examiner

PIXEL DRIVING CIRCUIT, PIXEL DRIVING METHOD, ARRAY SUBSTRATE, AND DISPLAY DEVICE

CROSS-REFERENCE TO RELATED APPLICATION APPLICATIONS

This application is the U.S. national phase of PCT Application No. PCT/CN2018/115178 filed on Nov. 13, 2018, which claims priority to Chinese Patent Application No. 201810320203.7 filed on Apr. 11, 2018, which are incorporated herein by reference in their entireties.

TECHNICAL FIELD

The present disclosure relates to the field of display compensation technology, and in particular to a pixel driving circuit, a pixel driving method, an array substrate and a display device.

BACKGROUND

The active-matrix organic light emitting diode (AMOLED) display product is limited by the large threshold voltage drift of the oxide thin film transistor (oxide TFT), and requires an external compensation mechanism to overcome the above defect and provide an improved display effect.

SUMMARY

A pixel driving circuit includes a pixel driving unit and an optical detection unit;

wherein the pixel driving unit is configured to drive a light-emitting element included in a pixel unit to emit light;

the optical detection unit includes a photoelectric conversion sub-circuit and a switch control sub-circuit;

the photoelectric conversion sub-circuit is configured to receive light emitted from the light-emitting element, and convert the light into an electrical signal;

the switch control sub-circuit is configured to control an output of the electrical signal under control of a first scanning signal; and the pixel driving unit is further configured to adjust brightness of the light emitted from the light-emitting element according to the electrical signal.

In some embodiments, the photoelectric conversion sub-circuit includes a photodiode; the switch control sub-circuit includes a switch control transistor;

an anode of the photodiode receives a first voltage signal, a cathode of the photodiode is connected to a first electrode of the switch control transistor; and a gate electrode of the switch control transistor receives the first scanning signal, a second electrode of the switch control transistor outputs the electrical signal.

In some embodiments, the pixel driving unit includes a driving sub-circuit, a storage capacitor sub-circuit and a data writing sub-circuit, wherein the data writing sub-circuit is configured to write a data voltage signal into a control terminal of the driving sub-circuit under control of a second scanning signal;

a first terminal of the driving sub-circuit receives a second voltage signal, a second terminal of the driving sub-circuit is connected to the light-emitting element, the driving sub-circuit is configured to drive the light-emitting element to emit light under control of a signal on the control terminal thereof; and a first terminal of the storage capacitor sub-circuit is connected to the control terminal of the driving sub-circuit, a second terminal of the storage capacitor sub-circuit is connected to the second terminal of the driving sub-circuit.

In some embodiments, the driving sub-circuit includes a driving transistor;

the control terminal of the driving sub-circuit is a gate electrode of the driving transistor, the first terminal of the driving sub-circuit is a first electrode of the driving transistor, and the second terminal of the driving sub-circuit is a second electrode of the driving transistor.

In some embodiments, the pixel driving unit further includes a reset control sub-circuit;

the reset control sub-circuit is configured to reset a potential of the second electrode of the driving transistor under control of the second scanning signal, so as to control the driving transistor to be turned on.

In some embodiments, the reset control sub-circuit includes a reset control transistor, a gate electrode of the reset control transistor receives the second scanning signal, a first electrode of the reset control transistor is connected to the second electrode of the driving transistor, and a second electrode of the reset control transistor receives a third voltage signal;

the data writing sub-circuit includes a data writing transistor, a gate electrode of the data writing transistor receives the second scanning signal, a first electrode of the data writing transistor receives the data voltage signal, and a second electrode of the data writing transistor is connected to the gate electrode of the driving transistor;

the data writing transistor and the reset control transistor are both n-type transistors, or are both p-type transistors; and the storage capacitor sub-circuit includes a storage capacitor, a first terminal of the storage capacitor is connected to the gate electrode of the driving transistor, and a second terminal of the storage capacitor is connected to the light-emitting element.

In some embodiments, the pixel driving circuit further includes a compensation sub-circuit;

wherein the compensation sub-circuit is connected to the switch control sub-circuit; and the compensation sub-circuit is configured to obtain a corresponding compensation data voltage signal according to the electrical signal.

A pixel driving method applied to the above pixel driving circuit includes a display stage and an optical detection stage, wherein, in the display stage, the pixel driving unit drives the light-emitting element comprised in the pixel unit to emit light;

in the optical detection stage, the pixel driving unit continues driving the light-emitting element to emit light, the photoelectric conversion sub-circuit receives the light emitted from the light-emitting element and converts the light into an electrical signal; the switch control sub-circuit controls an output of the electrical signal under control of the first scanning signal; and the pixel driving unit adjusts brightness of the light emitted from the light-emitting element according to the electrical signal.

In some embodiments, the pixel driving unit includes a driving sub-circuit, a storage capacitor sub-circuit, a data writing sub-circuit and a reset control sub-circuit; the driving sub-circuit comprises a driving transistor;

the display stage comprises a data writing period and a light-emitting period set in sequence;

the step that the pixel driving unit drives the light-emitting element to emit light in the display stage includes:

in the data writing period included in the display stage, under control of a second scanning signal, the data writing sub-circuit controls a data voltage signal to be written into a gate electrode of the driving transistor, and the reset control sub-circuit resets a potential of a second electrode of the driving transistor so as to turn on the driving transistor;

in the light-emitting period included in the display stage, under control of the second scanning signal, the data writing sub-circuit stops writing the data voltage signal into the gate electrode of the driving transistor, the reset control sub-circuit stops resetting the potential of the second electrode of the driving transistor, the driving transistor remains in an ON state, a second voltage input terminal charges the storage capacitor sub-circuit such that the potential of the second electrode of the driving transistor is raised to drive the light-emitting element to emit light.

In some embodiments, the pixel driving circuit further includes a compensation sub-circuit; the compensation sub-circuit is connected to the switch control sub-circuit;

the pixel driving method further includes:

in the optical detection stage, the compensation sub-circuit generates a compensation data voltage signal according to the electrical signal from the switch control sub-circuit.

An array substrate includes pixel units arranged in an array, a plurality of first scanning lines, a plurality of second scanning lines, a plurality of data lines and a plurality of compensation lines; each of the pixel units includes a light-emitting element and the above pixel driving circuit; the light-emitting element is connected to the pixel driving circuit; the first scanning lines and the second scanning lines extend along a row direction, and the data lines extend along a column direction;

the pixel driving circuits in a same row are connected to a first scanning line and a second scanning line for the row respectively;

the pixel driving circuits in a same column are connected to a data line for the column;

each pixel driving circuit is connected to one compensation line;

the first scanning line for the row is configured to output a first scanning signal, the second scanning line for the row is configured to output a second scanning signal, the data line for the column is configured to output a data voltage signal, the compensation line is configured to receive an electrical signal outputted from a photoelectric conversion sub-circuit in a pixel driving circuit.

A display device includes a data driving circuit which is connected to a plurality of columns of data lines respectively, a compensation circuit and the above array substrate;

the compensation circuit is connected to the data driving circuit and the plurality of compensation lines included in the array substrate respectively, the compensation circuit is configured to generate a compensation data voltage signal according to an electrical signal from each compensation line, and transmit the compensation data voltage signal to the data driving circuit;

the data driving circuit is configured to adjust the data voltage signals outputted to the plurality of data lines according to the compensation data voltage signals.

In some embodiments, the array substrate includes a first substrate, and the display device further includes a second substrate opposite to the first substrate;

the light-emitting elements are bottom emitting organic light-emitting diodes;

a surface of the first substrate facing the second substrate is provided thereon with a photoelectric conversion structure and a light-emitting element structure, the photoelectric conversion structure is located at a light exiting side of the light-emitting element structure;

the photoelectric conversion structure includes a plurality of rows and columns of the photoelectric conversion sub-circuits, the light-emitting element structure includes a plurality of rows and columns of the bottom emitting organic light-emitting diodes;

each photoelectric conversion sub-circuit corresponds to one bottom emitting organic light-emitting diode;

an orthographic projection of each photoelectric conversion sub-circuit on the first substrate is located within an orthographic projection of a corresponding bottom emitting organic light-emitting diode on the first substrate.

In some embodiments, the display device further includes a color filter layer provided at the light exiting side of the light-emitting element structure;

wherein the bottom emitting organic light-emitting diodes are configured to emit white light;

the color filter layer includes a plurality of rows and columns of color filter units; each color filter unit corresponds to one bottom emitting organic light-emitting diode;

an orthographic projection of each color filter unit on the first substrate is located within an orthographic projection of a corresponding bottom emitting organic light-emitting diode on the first substrate, and does not overlap with an orthographic projection of a photoelectric conversion sub-circuit on the first substrate, which photoelectric conversion sub-circuit corresponds to the corresponding bottom emitting organic light-emitting diode.

A driving method of a display device applied to the above display device includes:

in a display stage, each pixel driving unit drives a light-emitting element connected thereto to emit light;

in an optical detection stage, the pixel driving unit continues driving the light-emitting element to emit light, the photoelectric conversion sub-circuit receives the light emitted from the light-emitting element and converts the light into an electrical signal; the switch control sub-circuit controls an output of the electrical signal to a compensation line under control of a first scanning signal on a first scanning line for the row; the compensation circuit receives the electrical signal on the compensation line, generates a compensation data voltage signal according to the electrical signal, and transmits the compensation data voltage signal to the data driving circuit; and the data driving circuit adjusts a data voltage signal outputted to a data line for the column according to the compensation data voltage signal, so as to adjust brightness of the light emitted from the light-emitting element.

DETAILED DESCRIPTION

Figure 1:
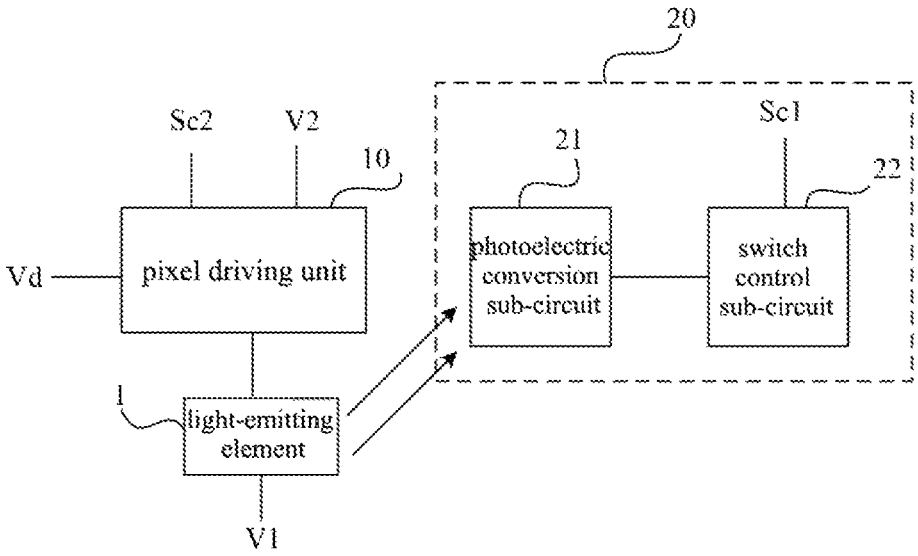
FIG. 1 is a structural diagram of a pixel driving circuit provided by some embodiments.

The method of using the external compensation mechanism to compensate for the large threshold voltage drift of the oxide TFT is to perform optical compensation on the display panel before the AMOLED display leaves the factory. This method can only be performed before the AMOLED display leaves the factory, and cannot achieve the optical compensation on the AMOLED display panel after it is shipped from the factory or being used for a period of time. After the AMOLED display is shipped from the factory or being used for a period of time, due to the factors such as mobility change of the driving transistors or the aging of the light-emitting element, the pixel units may have a non-uniform display, which cannot be optically compensated after the AMOLED display is shipped from the factory.

In the following embodiments, the transistors are thin film transistors.

In some embodiments, the transistors are field effect transistors.

In the following embodiments, in order to distinguish two electrodes of the transistor except the gate electrode, one of the two electrodes is called the first electrode, and the other is called the second electrode.

In some embodiments, the first electrode is the drain electrode and the second electrode is the source electrode.

In some embodiments, the first electrode is the source electrode and the second electrode is the drain electrode.

Some embodiments provide a pixel driving circuit which includes a pixel driving unit and an optical detection unit.

The pixel driving unit is connected to a light-emitting element, and is configured to drive the light-emitting element to emit light.

The optical detection unit includes a photoelectric conversion sub-circuit and a switch control sub-circuit.

The photoelectric conversion sub-circuit is configured to receive light emitted from the light-emitting element, and converts the light emitted from the light-emitting element into an electrical signal.

The switch control sub-circuit is configured to control an output of the electrical signal under control of the first scanning signal.

The pixel driving unit is further configured to adjust brightness of the light emitted from the light-emitting element according to the electrical signal.

The pixel driving circuit provided by the above embodiments includes the pixel driving unit and the optical detection unit; the pixel driving unit is configured to drive the light-emitting element to emit light; the optical detection unit includes a photoelectric conversion sub-circuit and a switch control sub-circuit; the photoelectric conversion sub-circuit is configured to receive light emitted from the light-emitting element and converts the light emitted from the light-emitting element into an electrical signal, and the electrical signal is outputted by the switch control sub-circuit under control of the first scanning signal so that an external compensation circuit obtain a compensation data voltage signal according to the electrical signal, so as to adjust a data voltage signal on a data line for the column in the next display period and thus adjust brightness of the light emitted from the light-emitting element.

After the display device is used for a certain period of time, the pixel driving circuit in the above embodiment is used to compensate the data voltage. After the display device is shipped from the factory or being used, the pixel driving circuit is used to compensate the threshold voltage drift of the driving transistor, so as to avoid deviation of the display brightness and improve the uniformity of the display brightness.

As shown in FIG. 1, the pixel driving circuit includes the pixel driving unit 10 and the optical detection unit 20.

The pixel driving unit 10 is connected to a first terminal of the light-emitting element 1 (the pixel driving unit 10 is configured to drive the light-emitting element 1 to emit light), and a second terminal of the light-emitting element 1 receives a first voltage signal V1.

The pixel driving unit 10 receives a second scanning signal Sc2, a data voltage signal Vd and a second voltage signal V2. The pixel driving unit 10 is connected to a first electrode of the light-emitting element 1.

The optical detection unit 20 includes the photoelectric conversion sub-circuit 21 and a switch control sub-circuit 22.

The photoelectric conversion sub-circuit 21 is configured to receive the light emitted from the light-emitting element 1, and convert the light emitted from the light-emitting element 1 into an electrical signal.

The switch control sub-circuit 22 is connected to the photoelectric conversion sub-circuit 21, and the switch control sub-circuit 22 receives the first scanning signal Sc1. The switch control sub-circuit 22 is configured to control an output of the electrical signal under control of the first scanning signal Sc1.

The pixel driving unit 10 adjusts the brightness of the light emitted from the light-emitting element 1 according to the electrical signal.

In some embodiments, the switch control sub-circuit 22 outputs the electrical signal to the external compensation circuit via a compensation line under control of the first scanning signal Sc1. The external compensation circuit obtains the compensation data voltage signal according to the electrical signal, adjusts the data voltage signal on the data line connected to the pixel driving circuit in the next display period. In this way, the brightness of the light emitted from the light-emitting element may be adjusted, thereby improving the uniformity of the brightness of the display product caused by the factors such as the change in the mobility or the change in the threshold voltage of the driving transistor, or aging of the light-emitting element, etc.

In some embodiments, the first voltage signal V1 is a low voltage signal, and the second voltage signal V2 is a high voltage signal.

Figure 2:
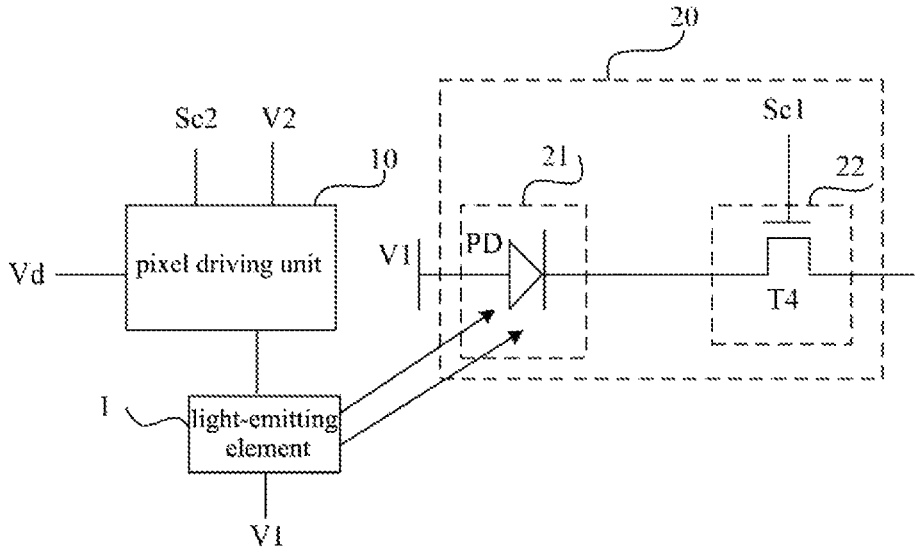
FIG. 2 is a circuit diagram of a pixel driving circuit provided by some other embodiments.

In some embodiments, the photoelectric conversion sub-circuit includes a photodiode, and the switch control sub-circuit includes a switch control transistor. An anode of the photodiode receives the first voltage signal, a cathode of the photodiode is connected to a first electrode of the switch control transistor, a gate electrode of the switch control transistor receives the first scanning signal, and a second electrode of the switch control transistor outputs the electrical signal. In some embodiments, as shown in FIG. 2, on the basis of the embodiment shown in FIG. 1, the photoelectric conversion sub-circuit 21 includes a photodiode (PD), and the switch control sub-circuit 22 includes a switch control transistor T4.

The anode of the photodiode PD receives the first voltage signal V1, and the cathode of the photodiode PD is connected to a drain electrode of the switch control transistor T4.

A gate electrode of the switch control transistor T4 receives the first scanning signal Sc1, and a source electrode of the switch control transistor T4 outputs the electrical signal.

In some embodiments, V1 is a low voltage signal so that the photodiode PD is in a reverse bias state. The photodiode PD can perform the photoelectric conversion only in the reverse bias state.

When the pixel driving circuit shown in FIG. 2 is working, the display stage and the optical detection stage are separated in time.

In the display stage, the pixel driving unit 10 drives the light-emitting element 1 to emit light.

In the optical detection stage, the pixel driving unit 10 continues driving the light-emitting element 1 to emit light, the photoelectric conversion sub-circuit 21 included in the optical detection unit 20 converts the light emitted from the light-emitting element 1 into an electrical signal, and the switch control sub-circuit 22 controls an output of the electrical signal under control of the first scanning signal Sc1.

In some embodiments, the pixel driving unit includes a driving sub-circuit, a storage capacitor sub-circuit and a data writing sub-circuit.

The data writing sub-circuit is configured to control the data voltage signal to be written into a control terminal of the driving sub-circuit under control of the second scanning signal.

A first terminal of the driving sub-circuit receives the second voltage signal, a second terminal of the driving sub-circuit is connected to the light-emitting element. The driving sub-circuit is configured to drive the light-emitting element to emit light under control of the signal at its control terminal.

A first terminal of the storage capacitor sub-circuit is connected to the control terminal of the driving sub-circuit, and a second terminal of the storage capacitor sub-circuit is connected to the second terminal of the driving sub-circuit.

In some embodiments, the driving sub-circuit includes a driving transistor, the control terminal of the driving sub-circuit is a gate electrode of the driving transistor, the first terminal of the driving sub-circuit is a first electrode of the driving transistor, and the second terminal of the driving sub-circuit is a second electrode of the driving transistor.

In some embodiments, the pixel driving unit further includes a reset control sub-circuit.

The reset control sub-circuit is configured to reset the second electrode of the driving transistor under control of the second scanning signal, so as to control the driving transistor to be turned on.

In the case that the pixel driving unit includes the reset control sub-circuit, in a data writing period included in the display stage, the potential of the source electrode of the driving transistor is reset so as to turn on the driving transistor properly.

In some embodiments, the reset control sub-circuit includes a reset control transistor, a gate electrode of the reset control transistor receives the signal of the second scanning line, a first electrode of the reset control transistor is connected to the second electrode of the driving transistor, and a second electrode of the reset control transistor receives a third voltage signal.

The data writing sub-circuit includes a data writing transistor, a gate electrode of the data writing transistor receives the second scanning signal, a first electrode of the data writing transistor receives the data voltage signal, and a second electrode of the data writing transistor is connected to the gate electrode of the driving transistor.

In some embodiments, the data writing transistor and the reset control transistor are both n-type transistors.

In some embodiments, the data writing transistor and the reset control transistor are both p-type transistors.

The storage capacitor sub-circuit includes a storage capacitor, a first terminal of the storage capacitor is connected to the gate electrode of the driving transistor, and a second terminal of the storage capacitor is connected to the light-emitting element.

In some embodiments, when the driving transistor is an n-type transistor, the third voltage signal is a low voltage signal.

In some embodiments, when the driving transistor is a p-type transistor, the third voltage signal is a high voltage signal.

In some embodiments, the pixel driving circuit further includes a compensation sub-circuit.

The compensation sub-circuit is connected to the switch control sub-circuit.

The compensation sub-circuit is configured to generate a compensation data voltage signal according to the electrical signal.

Figure 3:
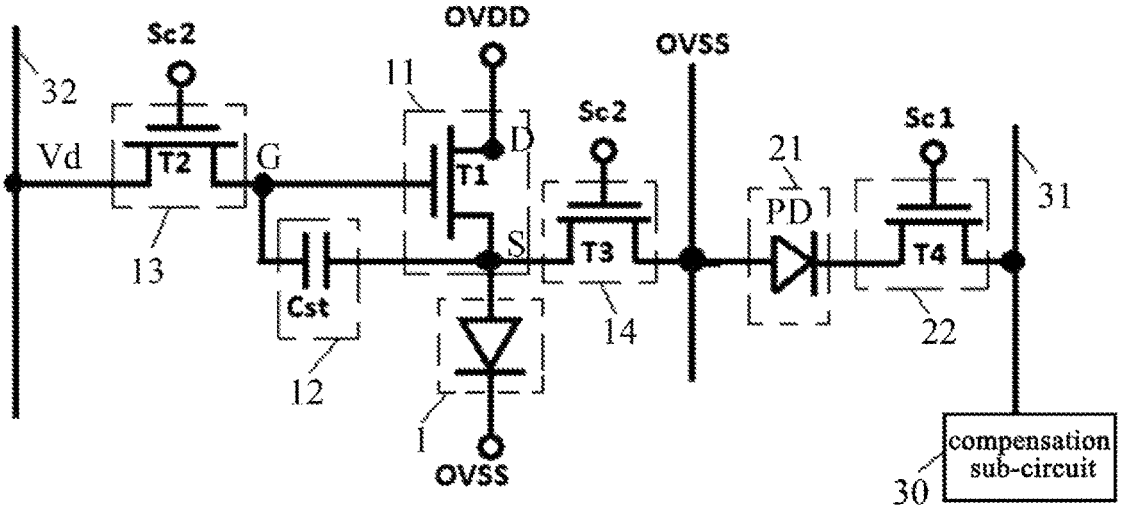
FIG. 3 is a circuit diagram of a pixel driving circuit provided by some other embodiments.

In some embodiments, as shown in FIGS. 2 and 3, the pixel driving circuit includes the pixel driving unit 10, the optical detection unit 20 and the compensation sub-circuit 30.

In FIG. 3, the light-emitting element 1 connected to the pixel driving unit is an organic light emitting diode (OLED).

As shown in FIG. 3, the optical detection unit includes a photoelectric conversion sub-circuit 21 and a switch control sub-circuit 22.

The photoelectric conversion sub-circuit 21 includes a photodiode PD, and the switch control sub-circuit 22 includes a switch control transistor T4.

The anode of the photodiode PD receives a low voltage signal OVSS, and the cathode of the photodiode PD is connected to the drain electrode of the switch control transistor T4.

The gate electrode of the switch control transistor T4 receives the first scanning signal Sc1, and the source electrode of the switch control transistor T4 is connected to a compensation line 31.

As shown in FIGS. 2 and 3, the pixel driving unit 10 includes the driving sub-circuit 11, the storage capacitor sub-circuit 12, the data writing sub-circuit 13 and the reset control sub-circuit 14.

The driving sub-circuit 11 includes a driving transistor T1, and the storage capacitor sub-circuit 12 includes a storage capacitor Cst.

A first terminal of the storage capacitor Cst is connected to a gate electrode G of the driving transistor T1, and a second terminal of the storage capacitor Cst is connected to the anode of the light-emitting element 1 (OLED).

A drain electrode D of the driving transistor T1 receives a high voltage signal OVDD, a source electrode S of the driving transistor T1 is connected to the anode of the OLED, and the cathode of the OLED receives a low voltage signal OVSS.

The data writing sub-circuit 13 includes a data writing transistor T2, a gate electrode of the data writing transistor T2 receives the second scanning signal Sc2, a drain electrode of the data writing transistor T2 receives the data voltage signal Vd, and a source electrode of the data writing transistor T2 is connected to the gate electrode G of the driving transistor T1.

The reset control sub-circuit 14 includes a reset control transistor T3, a gate electrode of the reset control transistor T3 receives the second scanning signal Sc2, a drain electrode of the reset control transistor T3 is connected to the source electrode of the driving transistor T1, and a source electrode of the reset control transistor T3 receives the low voltage signal OVSS.

The compensation sub-circuit 30 is connected to the compensation line 31, and is configured to generate the compensation data voltage signal according to the electrical signal from the compensation line 31.

In the embodiment shown in FIG. 3, Vd is provided by a data line 32, and the drain electrode of T2 is connected to the data line 32.

In some embodiments, the compensation sub-circuit 30 is provided in a driving integrated circuit (IC).

In the embodiment as shown in FIG. 3, all the transistors are n-type transistors.

In some embodiments, the transistors in FIG. 3 are p-type transistors.

During processing of the pixel driving circuit shown in FIG. 3, the display stage and the optical detection stage are separate stages, and the display stage includes a data writing period and a light-emitting period set in sequence.

In the data writing period included in the display stage, Sc2 is a high level signal and the data line 32 outputs the data voltage signal Vd, thus T2 and T3 are turned on, Vd is written into the gate electrode G of T1, and the source electrode S of T2 is supplied with OVSS (e.g., OVSS is equal to 0V) to fix the voltage across Cst and turn on T1; Sc1 is a low level signal, thus T4 is turned off, and the cathode of PD is disconnected from the compensation line 31.

In the light-emitting period of the display stage, Sc2 is a low level signal, thus T2 and T3 are turned off and T1 remains on, the source electrode S of T1 is charged by OVDD; after the potential of the source electrode S of T1 rises to OVSS+Voled (wherein, Voled is the threshold voltage of the OLED), the OLED starts to emitting light. When the potential of the source voltage S of T1 rises, due to the coupling effect of Cst, the potential of the gate electrode G of T1 is also raised by an equal potential while the gate-source voltage Vgs of T1 remains unchanged. Hence, the pixel driving unit included in the pixel driving circuit shown in FIG. 3 can compensate for the IR (wherein, I represents the current, and R represents the resistance) drop (the IR drop is a phenomenon in which the voltage on the power and ground network in an integrated circuit drops or rises) on the voltage line for outputting OVSS.

In the light-emitting period, Sc1 is a low level signal so that T4 is turned off to disconnect the cathode of PD from SL.

In the photoelectric detection stage, Sc2 is a low level signal so that T2 and T3 are both turned off to disconnect the data line 32 from the gate electrode G of T1, thereby the source electrode S of T1 does not receive OVSS, T1 remains on, and T1 continues driving the OLED to emit light so that the photodiode PD senses the intensity of the optical signal emitted by the OLED and generates the photo-generated charges; Sc1 is a high level signal so that T4 is turned on, the photo-generated charges from PD is transferred to a parasitic capacitor of the compensation line 31 and is transformed to a voltage signal. The compensation sub-circuit 30 detects and stores the voltage signal, generates a corresponding compensation data voltage signal according to the voltage signal, and transmits the compensation data voltage signal to the data driving circuit, so that the data driving circuit adjusts the data voltage signal outputted to a corresponding data line according to the compensation data voltage signal in the data writing period in the next display stage, thereby improving the uniformity of the brightness of the display product caused by the factors present in the pixel unit (which includes the above pixel driving unit and the light-emitting element connected thereto), such as the change in the mobility or the change in the threshold voltage of the driving transistor, or the aging of the light-emitting element, etc.

In some embodiments, provided is a pixel driving method which is applied in the above pixel driving circuit.

Figure 4:
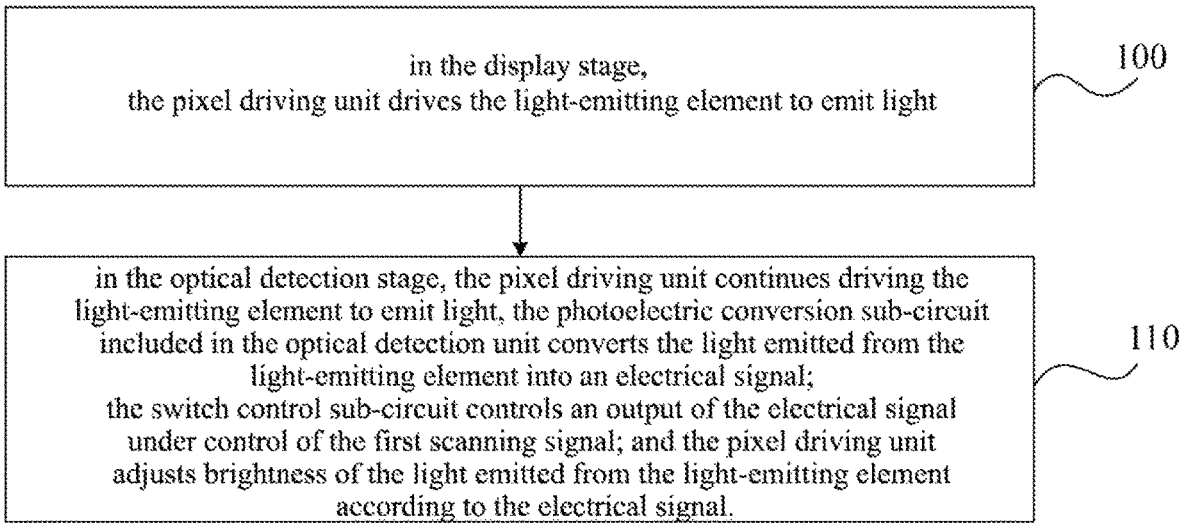
FIG. 4 is a flow chart of a pixel driving method provided by some embodiments.

As shown in FIG. 4, the pixel driving method includes Step 100 and Step 110.

In Step 100, in the display stage, the pixel driving unit drives the light-emitting element to emit light.

In Step 110, in the optical detection stage, the pixel driving unit continues driving the light-emitting element to emit light, the photoelectric conversion sub-circuit included in the optical detection unit converts the light emitted from the light-emitting element into an electrical signal; the switch control sub-circuit controls an output of the electrical signal under control of the first scanning signal, and the pixel driving unit adjusts brightness of the light emitted from the light-emitting element according to the electrical signal.

In the display stage, the switch control sub-circuit does not output the electrical signal.

In the pixel driving method provided by the above embodiment, the display stage and the optical detection stage are separated in time. After the display device is used for a certain period of time, the pixel driving method provided by the above embodiment is used to compensate the data voltage, thereby avoiding deviation of the display brightness caused by the threshold voltage drift of the driving transistor included in the driving sub-circuit in the pixel driving unit after the display device is shipped from the factory or being used for a period of time.

In some embodiments, the pixel driving unit includes a driving sub-circuit, a storage capacitor sub-circuit, a data writing sub-circuit and a reset control sub-circuit, the driving sub-circuit includes a driving transistor, and the display stage includes a data writing period and a light-emitting period set in sequence.

The step that the pixel driving unit drives the light-emitting element to emit light includes:

In the data writing period included in the display stage, under control of the second scanning signal, the data writing sub-circuit controls the data voltage signal to be written into the gate electrode of the driving transistor, and the reset control sub-circuit resets the second electrode of the driving transistor so as to turn on the driving transistor.

In the light-emitting period included in the display stage, under control of the second scanning signal, the data writing sub-circuit stops writing the data voltage signal into the gate electrode of the driving transistor, the reset control sub-circuit stops resetting the potential of the second electrode of the driving transistor, the driving transistor remains in an ON state, the second voltage input terminal charges the storage capacitor sub-circuit such that the potential of the second electrode of the driving transistor is raised to drive the light-emitting element to emit light.

The display stage includes the data writing period and the light-emitting period set in sequence. In the data writing period, the data voltage signal is written into the gate electrode of the driving transistor. In the light-emitting period, the driving transistor drives the light-emitting element to emit light.

In some embodiments, the pixel driving circuit further includes a compensation sub-circuit, the compensation sub-circuit is connected to the switch control sub-circuit, and the pixel driving method further includes the following step:

in the optical detection stage, the compensation sub-circuit generates a corresponding compensation data voltage signal according to the electrical signal.

The pixel driving circuit includes the compensation sub-circuit, the compensation sub-circuit generates the corresponding compensation data voltage signal according to the electrical signal in the optical detection stage, so as to compensate the data voltage signal transferred to the data line for the column according to the compensation data voltage signal in the data writing period in the subsequent display period.

Figure 5:
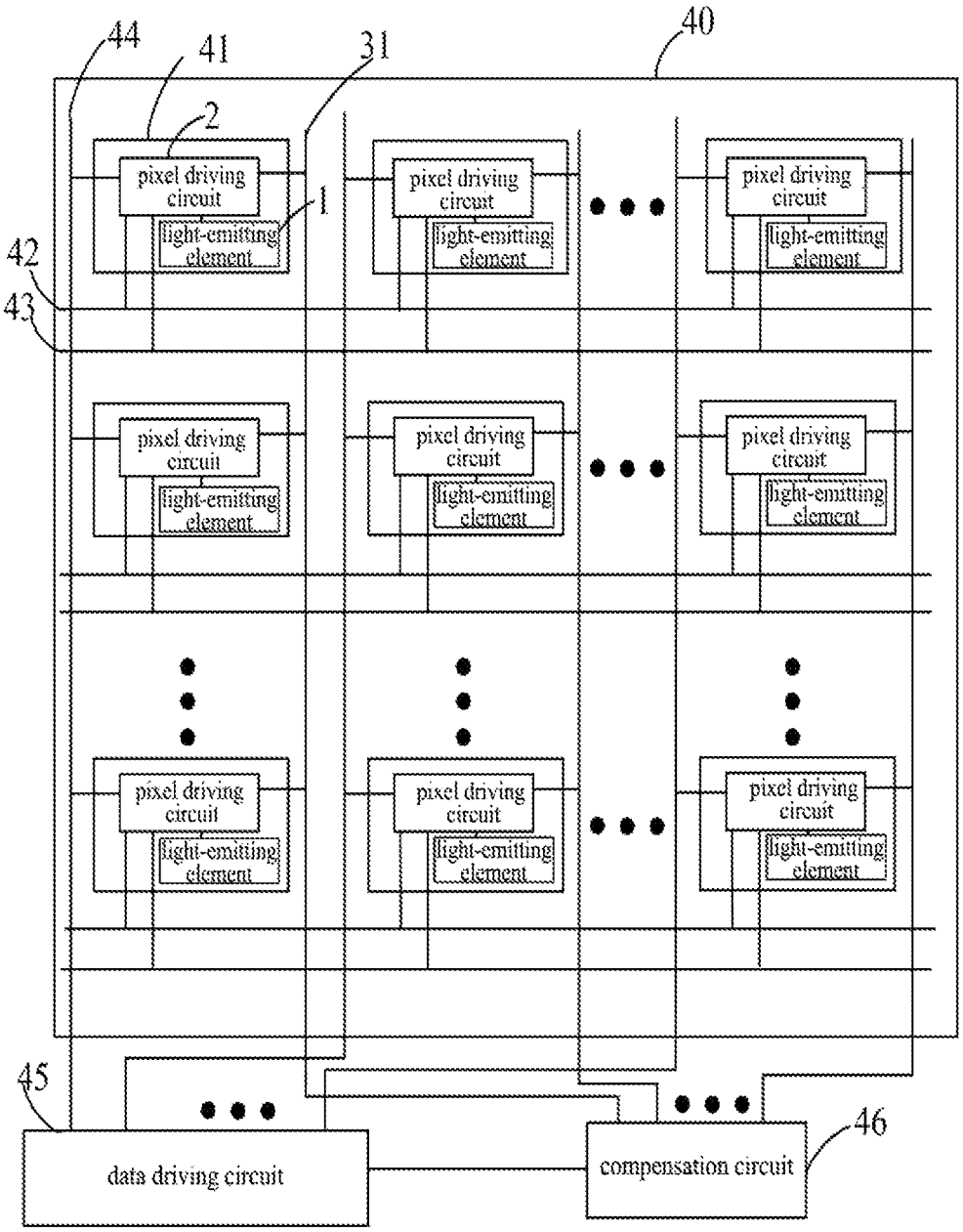
FIG. 5 is a structural diagram of a display device provided by some embodiments.

In some embodiments, provided is an array substrate 40. As shown in FIG. 5, the array substrate 40 includes pixel units 41 arranged in an array, a plurality of first scanning lines 42, a plurality of second scanning lines 43, a plurality of data lines 44 and a plurality of compensation lines 31; each of the pixel units 41 includes the above light-emitting element 1 and the pixel driving circuit 2 (i.e., the pixel driving circuit in the above embodiments), and the light-emitting element 1 is connected to the pixel driving circuit 2, wherein the pixel driving unit in the pixel driving circuit 2 does not include the compensation sub-circuit. The pixel driving circuits 2 in a same row are connected to the first scanning line 42 and the second scanning line 43 for the row respectively.

The pixel driving circuits 2 in a same column are connected to the data line 44 for the column.

Each pixel driving circuit 2 is connected to one compensation line 31.

The first scanning line 42 for the row is configured to output the first scanning signal Sc1, the second scanning line 43 for the row is configured to output the second scanning signal Sc2, the data line 44 for the column is configured to output the data voltage signal, the compensation line 31 is configured to receive the electrical signal outputted from the pixel driving circuit 2, and the pixel driving unit in the pixel driving circuit 2 is configured to adjust the brightness of the light emitted from the light-emitting element 1 according to the electrical signal.

In the array substrate in the above embodiment, each of the pixel driving circuits is connected to one compensation line respectively. In the optical detection stage, the compensation circuit acquires the photoelectric signals of the pixels on the entire screen via the plurality of the compensation lines, respectively, and compensates for the non-uniformity of the display brightness of the pixels on the entire screen caused by the factors such as the change in the mobility or the change in the threshold voltage of the driving transistors or the aging of the light-emitting element, etc., according to the photoelectric signals.

In some embodiments, provided is a display device including a data driving circuit 45 which is connected to a plurality of columns of data lines 44 respectively, a compensation circuit 46 and the above array substrate 40.

The compensation circuit 46 is connected to the data driving circuit 45 and a plurality of compensation lines 31 included in the array substrate 40 respectively. The compensation circuit 46 is configured to generate the compensation data voltage signals according to the electrical signals from the compensation lines 31, and transmit the compensation data voltage signals to the data driving circuit 45.

The data driving circuit 45 is configured to adjust the data voltage signals outputted to the data lines 44 according to the compensation data voltage signals.

In the above embodiment, the display device includes the above array substrate and the compensation circuit, the compensation circuit is connected to the plurality of compensation lines and the data driving circuit, and is configured to generate the corresponding compensation data voltage signals according to the electrical signals from the compensation lines, and to transfer the compensation data voltage signals to the data driving circuit; and the data driving circuit adjusts the data voltage signals outputted to the data lines according to the compensation data voltage signals.

In some embodiments, the array substrate includes a first substrate, and the display device further includes a second substrate opposite to the first substrate.

In some embodiments, the light-emitting element is a bottom emitting organic light-emitting diode.

A surface of the first substrate facing the second substrate is provided thereon with a photoelectric conversion structure and a light-emitting element structure, and the photoelectric conversion structure is located at a light exiting side of the light-emitting element structure.

The photoelectric conversion structure includes a plurality of rows and columns of photoelectric conversion sub-circuit, and the light-emitting element structure includes a plurality of rows and columns of the bottom emitting organic light-emitting diodes.

Each photoelectric conversion sub-circuit corresponds to one bottom emitting organic light-emitting diode.

An orthographic projection of each photoelectric conversion sub-circuit on the first substrate is located within an orthographic projection of a corresponding bottom emitting organic light-emitting diode on the first substrate.

In some embodiments, if the light-emitting element is an organic light-emitting diode, the light-emitting element is a bottom emitting organic light-emitting diode (if the light-emitting element is a bottom emitting organic light-emitting diode, the light-emitting element emits light upward, and the photodiode cannot detect the light emitted by the light-emitting element completely).

In some embodiments, the bottom emitting organic light-emitting diode is configured to emit white light, and the display device further includes a color filter layer provided at the light exiting side of the light-emitting element structure.

The color filter layer includes a plurality of rows and columns of color filter units. Each color filter unit corresponds to one bottom emitting organic light-emitting diode. An orthographic projection of each color filter unit on the first substrate is located within an orthographic projection of the corresponding bottom emitting organic light-emitting diode on the first substrate, and does not overlap with an orthographic projection of a photoelectric conversion sub-circuit on the first substrate, which photoelectric conversion sub-circuit corresponds to the corresponding bottom emitting organic light-emitting diode.

If the bottom emitting organic light-emitting diode emits white light, the photoelectric diode receives the white light, and the white light emitted by the bottom emitting organic light-emitting diode passes through the color filter layer to present various colors.

In some embodiments, as shown in FIG. 5, the array substrate includes a first substrate 51, and the display device further includes a second substrate 52 opposite to the first substrate 51.

The light-emitting element 1 is a bottom emitting organic light-emitting diode.

A surface of the first substrate 51 facing the second substrate 52 is provided thereon with a photoelectric conversion structure and a light-emitting element structure, and the photoelectric conversion structure is located at a light exiting side of the light-emitting element structure.

The photoelectric conversion structure includes a plurality of rows and columns of photoelectric conversion sub-circuit, and the light-emitting element structure includes a plurality of rows and columns of the bottom emitting organic light-emitting diodes.

Each of the photoelectric conversion sub-circuits corresponds to one of the bottom emitting organic light-emitting diodes.

The bottom emitting organic light-emitting diode is configured to emit white light.

The display device further includes a color filter layer provided at the light exiting side of the light-emitting element structure.

The color filter layer includes a plurality of rows and columns of color filter units. Each color filter unit corresponds to one bottom emitting organic light-emitting diode.

Figure 6:
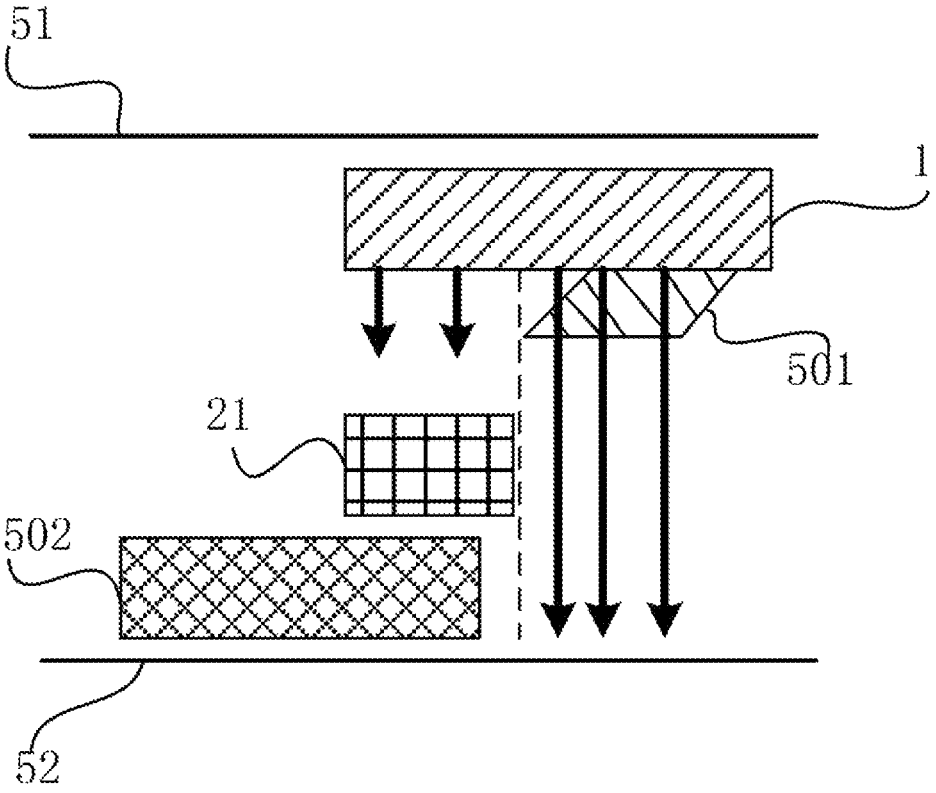
FIG. 6 is a structural diagram of a pixel unit included in the display device in FIG. 5.

In FIG. 6, a pixel unit in the array substrate 40 is shown. The pixel unit includes a photoelectric conversion sub-circuit 21, an bottom emitting organic light-emitting diode (BEOLED) 1 and a color filter unit 501 (for example, the color filter unit 501 includes color filters of three colors Red (R), Green (G) and Blue (B). The photoelectric conversion sub-circuit 21 and the bottom emitting organic light-emitting diode 1 are arranged in a one-to-one correspondence, the color filter unit 501 and the bottom emitting organic light-emitting diode 1 are arranged in a one-to-one correspondence.

An orthographic projection of the photoelectric conversion sub-circuit 21 on the first substrate 51 is located within an orthographic projection of the corresponding bottom emitting organic light-emitting diode 1 on the first substrate 51.

The bottom emitting organic light-emitting diode 1 is configured to emit white light.

The display device further includes a color filter layer provided at the light exiting side of the light-emitting element structure.

An orthographic projection of the color filter unit 501 on the first substrate 51 is located within an orthographic projection of the corresponding bottom emitting organic light-emitting diode 1 on the first substrate 51, and does not overlap with an orthographic projection of a photoelectric conversion sub-circuit 21 corresponding to the corresponding bottom emitting organic light-emitting diode BEOLED on the first substrate 51.

In some embodiments, a TFT device 502 is provided on a surface of the second substrate 52 facing the first substrate 51.

The bottom emitting organic light-emitting diode emits white light, the photoelectric sub-circuit (which may be a photoelectric diode) receives the white light, and the white light emitted by the bottom emitting organic light-emitting diode passes through the color filter layer to present various colors.

In some embodiments, the pixel units, the first scanning lines, the second scanning lines, the data lines and the compensation lines included in the array substrate are all provided on the first substrate 51.

In some embodiments, provided is a driving method of a display device which is applied to the above display device.

The driving method of a display device includes a display stage and an optical detection stage.

In the display stage, each pixel driving unit drives the light-emitting element connected thereto to emit light, respectively.

In the optical detection stage, the pixel driving unit continues driving the light-emitting element to emit light, the photoelectric conversion sub-circuit converts the light emitted from the light-emitting element into an electrical signal; the switch control sub-circuit controls an output of the electrical signal to the compensation line under control of the first scanning signal on the first scanning line for the row; the compensation circuit obtains a corresponding compensation data voltage signal according to the electrical signal, and transmits the compensation data voltage signal to the data driving circuit; the data driving circuit adjusts the data voltage signal outputted to the data line for the column according to the compensation data voltage signal, to adjust brightness of the light emitted from the light-emitting element.

In the driving method of a display device provided by the above embodiment, the display stage and the optical detection stage are separated in time. After the display device is used for a certain period of time, the driving method of a display device provided by the above embodiment is used to compensate the data voltage, thereby avoiding deviation of the display brightness caused by the threshold voltage drift of the driving transistor included in the driving sub-circuit in the pixel driving unit after the display device is shipped from the factory or after being used for a period of time.

What is claimed is:

1. A pixel driving circuit comprising a pixel driving unit and an optical detection unit;

wherein the pixel driving unit is configured to drive a light-emitting element comprised in a pixel unit to emit light;

the optical detection unit comprises a photoelectric conversion sub-circuit and a switch control sub-circuit;

the photoelectric conversion sub-circuit is configured to receive light emitted from the light-emitting element, and convert the light into an electrical signal;

the switch control sub-circuit is configured to control an output of the electrical signal under control of a first scanning signal; and the pixel driving unit is further configured to adjust brightness of the light emitted from the light-emitting element according to the electrical signal, wherein the pixel driving unit comprises a driving sub-circuit, a storage capacitor sub-circuit and a data writing sub-circuit, wherein the data writing sub-circuit is configured to write a data voltage signal into a control terminal of the driving sub-circuit under control of a second scanning signal;

a first terminal of the driving sub-circuit receives a second voltage signal, a second terminal of the driving sub-circuit is connected to the light-emitting element, the driving sub-circuit is configured to drive the light-emitting element to emit light under control of a signal on the control terminal thereof; and a first terminal of the storage capacitor sub-circuit is connected to the control terminal of the driving sub-circuit, a second terminal of the storage capacitor sub-circuit is connected to the second terminal of the driving sub-circuit, wherein the driving sub-circuit comprises a driving transistor;

the control terminal of the driving sub-circuit is a gate electrode of the driving transistor, the first terminal of the driving sub-circuit is a first electrode of the driving transistor, and the second terminal of the driving sub-circuit is a second electrode of the driving transistor, wherein the pixel driving unit further comprises a reset control sub-circuit;

wherein the reset control sub-circuit is configured to reset a potential of the second electrode of the driving transistor under control of the second scanning signal, so as to control the driving transistor to be turned on.

2. The pixel driving circuit according to claim 1, wherein the photoelectric conversion sub-circuit comprises a photodiode; the switch control sub-circuit comprises a switch control transistor;

wherein an anode of the photodiode receives a first voltage signal, a cathode of the photodiode is connected to a first electrode of the switch control transistor; and a gate electrode of the switch control transistor receives the first scanning signal, a second electrode of the switch control transistor outputs the electrical signal.

3. The pixel driving circuit according to claim 1, wherein the reset control sub-circuit further comprises a reset control transistor, a gate electrode of the reset control transistor receives the second scanning signal, a first electrode of the reset control transistor is connected to the second electrode of the driving transistor, and a second electrode of the reset control transistor receives a third voltage signal;

the data writing sub-circuit comprises a data writing transistor, a gate electrode of the data writing transistor receives the second scanning signal, a first electrode of the data writing transistor receives the data voltage signal, and a second electrode of the data writing transistor is connected to the gate electrode of the driving transistor;

the data writing transistor and the reset control transistor are both n-type transistors, or are both p-type transistors; and the storage capacitor sub-circuit comprises a storage capacitor, a first terminal of the storage capacitor is connected to the gate electrode of the driving transistor, and a second terminal of the storage capacitor is connected to the light-emitting element.

4. The pixel driving circuit according to claim 1, further comprising a compensation sub-circuit;

wherein the compensation sub-circuit is connected to the switch control sub-circuit; and the compensation sub-circuit is configured to obtain a corresponding compensation data voltage signal according to the electrical signal.

5. A pixel driving method applied to a pixel driving circuit, wherein the pixel driving circuit includes a pixel driving unit and an optical detection unit;

wherein the pixel driving unit is configured to drive a light-emitting element comprised in a pixel unit to emit light;

the optical detection unit comprises a photoelectric conversion sub-circuit and a switch control sub-circuit;

the photoelectric conversion sub-circuit is configured to receive light emitted from the light-emitting element, and convert the light into an electrical signal;

the switch control sub-circuit is configured to control an output of the electrical signal under control of a first scanning signal; and the pixel driving unit is further configured to adjust brightness of the light emitted from the light-emitting element according to the electrical signal, the pixel driving method comprises a display stage and an optical detection stage, wherein, in the display stage, the pixel driving unit drives the light-emitting element comprised in the pixel unit to emit light; and in the optical detection stage, the pixel driving unit continues driving the light-emitting element to emit light, the photoelectric conversion sub-circuit receives the light emitted from the light-emitting element and converts the light into an electrical signal; the switch control sub-circuit controls an output of the electrical signal under control of the first scanning signal; and the pixel driving unit adjusts brightness of the light emitted from the light-emitting element according to the electrical signal.

6. The pixel driving method according to claim 5, wherein the pixel driving unit comprises a driving sub-circuit, a storage capacitor sub-circuit, a data writing sub-circuit and a reset control sub-circuit; the driving sub-circuit comprises a driving transistor;

the display stage comprises a data writing period and a light-emitting period set in sequence;

the step that the pixel driving unit drives the light-emitting element to emit light in the display stage comprises:

in the data writing period comprised in the display stage, under control of a second scanning signal, the data writing sub-circuit controls a data voltage signal to be written into a gate electrode of the driving transistor, and the reset control sub-circuit resets a potential of a second electrode of the driving transistor so as to turn on the driving transistor;

in the light-emitting period comprised in the display stage, under control of the second scanning signal, the data writing sub-circuit stops writing the data voltage signal into the gate electrode of the driving transistor, the reset control sub-circuit stops resetting the potential of the second electrode of the driving transistor, the driving transistor remains in an ON state, a second voltage input terminal charges the storage capacitor sub-circuit such that the potential of the second electrode of the driving transistor is raised to drive the light-emitting element to emit light.

7. The pixel driving method according to claim 5, wherein the pixel driving circuit further comprises a compensation sub-circuit; the compensation sub-circuit is connected to the switch control sub-circuit;

the pixel driving method further comprises:

in the optical detection stage, the compensation sub-circuit generates a compensation data voltage signal according to the electrical signal from the switch control sub-circuit.

8. An array substrate comprising pixel units arranged in an array, a plurality of first scanning lines, a plurality of second scanning lines, a plurality of data lines and a plurality of compensation lines; each of the pixel units comprises a light-emitting element and a pixel driving circuit;

wherein the pixel driving circuit includes a pixel driving unit and an optical detection unit;

wherein the pixel driving unit is configured to drive a light-emitting element comprised in a pixel unit to emit light;

the optical detection unit comprises a photoelectric conversion sub-circuit and a switch control sub-circuit;

the photoelectric conversion sub-circuit is configured to receive light emitted from the light-emitting element, and convert the light into an electrical signal;

the switch control sub-circuit is configured to control an output of the electrical signal under control of a first scanning signal; and the pixel driving unit is further configured to adjust brightness of the light emitted from the light-emitting element according to the electrical signal, the light-emitting element is connected to the pixel driving circuit; the first scanning lines and the second scanning lines extend along a row direction, and the data lines extend along a column direction;

the pixel driving circuits in a same row are connected to a first scanning line and a second scanning line for the row respectively;

the pixel driving circuits in a same column are connected to a data line for the column;

each pixel driving circuit is connected to one compensation line;

the first scanning line for the row is configured to output a first scanning signal, the second scanning line for the row is configured to output a second scanning signal, the data line for the column is configured to output a data voltage signal, the compensation line is configured to receive an electrical signal outputted from a photoelectric conversion sub-circuit in the pixel driving circuit.

9. The array substrate according to claim 8, wherein each column of pixel driving circuits are connected to one compensation line.

10. A display device comprising a data driving circuit which is connected to a plurality of columns of data lines respectively, a compensation circuit and the array substrate according to claim 8;

the compensation circuit is connected to the data driving circuit and the plurality of compensation lines comprised in the array substrate respectively, the compensation circuit is configured to generate a compensation data voltage signal according to an electrical signal from each compensation line, and transmit the compensation data voltage signal to the data driving circuit;

the data driving circuit is configured to adjust the data voltage signals outputted to the plurality of data lines according to the compensation data voltage signals.

11. The display device according to claim 10, wherein the array substrate comprises a first substrate, and the display device further comprise a second substrate opposite to the first substrate;

the light-emitting elements are bottom emitting organic light-emitting diodes;

a surface of the first substrate facing the second substrate is provided thereon with a photoelectric conversion structure and a light-emitting element structure, the photoelectric conversion structure is located at a light exiting side of the light-emitting element structure;

the photoelectric conversion structure comprises a plurality of rows and columns of the photoelectric conversion sub-circuits, the light-emitting element structure comprises a plurality of rows and columns of the bottom emitting organic light-emitting diodes;

each photoelectric conversion sub-circuit corresponds to one bottom emitting organic light-emitting diode;

an orthographic projection of each photoelectric conversion sub-circuit on the first substrate is located within an orthographic projection of a corresponding bottom emitting organic light-emitting diode on the first substrate.

12. The display device according to claim 11, further comprising a color filter layer provided at the light exiting side of the light-emitting element structure;

wherein the bottom emitting organic light-emitting diode is configured to emit white light;

the color filter layer comprises a plurality of rows and columns of color filter units; each color filter unit corresponds to one bottom emitting organic light-emitting diode;

an orthographic projection of each color filter unit on the first substrate is located within an orthographic projection of a corresponding bottom emitting organic light-emitting diode on the first substrate, and does not overlap with an orthographic projection of a photoelectric conversion sub-circuit on the first substrate, which photoelectric conversion sub-circuit corresponding to the corresponding bottom emitting organic light-emitting diode.

13. A driving method of a display device applied to the display device according to claim 10, comprising:

in a display stage, each pixel driving unit drives a light-emitting element connected thereto to emit light;

in an optical detection stage, the pixel driving unit continues driving the light-emitting element to emit light, the photoelectric conversion sub-circuit receives the light emitted from the light-emitting element and converts the light into an electrical signal; the switch control sub-circuit controls an output of the electrical signal to a compensation line under control of a first scanning signal on a first scanning line for the row; the compensation circuit receives the electrical signal on the compensation line, generates a compensation data voltage signal according to the electrical signal, and transmits the compensation data voltage signal to the data driving circuit; and the data driving circuit adjusts a data voltage signal outputted to a data line for the column according to the compensation data voltage signal, so as to adjust brightness of the light emitted from the light-emitting element.

14. The display device according to claim 10, wherein the compensation circuit is implemented in an integrated circuit (IC).

* * * * *